US007777686B2

(12) United States Patent
Desclos et al.

(10) Patent No.: US 7,777,686 B2
(45) Date of Patent: Aug. 17, 2010

(54) MULTI-LAYER ISOLATED MAGNETIC DIPOLE ANTENNA

(75) Inventors: Laurent Desclos, San Diego, CA (US); Jeffrey Shamblin, San Marcos, CA (US); Sebastian Rowson, San Diego, CA (US); Rowland Jones, Carlsbad, CA (US); Young Cha, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 235 days.

(21) Appl. No.: 12/059,346

(22) Filed: Mar. 31, 2008

(65) Prior Publication Data

US 2009/0243951 A1 Oct. 1, 2009

(51) Int. Cl.
*H01Q 9/28* (2006.01)

(52) U.S. Cl. ..... 343/795; 343/787; 343/846

(58) Field of Classification Search ..... 343/767, 343/787, 795, 829, 846, 700 MS
See application file for complete search history.

(56) References Cited

U.S. PATENT DOCUMENTS 4,587,524 A 5/1986 Hall
5,940,036 A * 8/1999 Oliver et al. ..... 343/700 MS
7,084,828 B2 8/2006 Rawnick
7,215,292 B2 * 5/2007 McLean ..... 343/725
7,388,550 B2 * 6/2008 McLean ..... 343/725
2006/0220966 A1 10/2006 Sarychev
2007/0120740 A1 5/2007 Iellici
2007/0229376 A1 * 10/2007 Desclos et al. ..... 343/718
2009/0224991 A1 * 9/2009 Rowson et al. ..... 343/747

* cited by examiner

*Primary Examiner*—Tho G Phan
(74) *Attorney, Agent, or Firm*—Joshua S. Schoonover; Coastal Patent, LLC

(57) ABSTRACT

A multi-layer isolated magnetic dipole (IMD) with improved bandwidth and efficiency characteristics to be used in wireless communications and other applicable systems. The multi-layer IMD antenna comprises an IMD element positioned above a ground plane, a conductive element positioned above a ground plane and coupled to the first portion having one or more slot regions being defined between the IMD element and the conductive element and one or more capacitive elements positioned across the one or more slot regions. The range of frequencies covered to be determined by the shape, size, and number of elements in the physical configuration of the components.

20 Claims, 10 Drawing Sheets

| | SINGLE FREQUENCY BAND IMD | DUAL FREQUENCY BAND IMD | TWO DIMENSIONAL (WIRE) IMD |
|---|---|---|---|
| BASIC IMD ANTENNA | 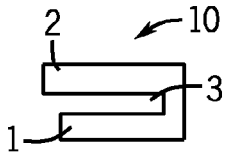  FIG. 1A | 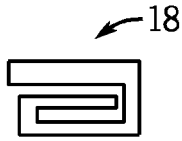  FIG. 1E | 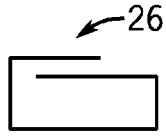  FIG. 1I |
| IMD3 ANTENNA CONCEPT | 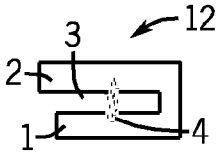  FIG. 1B | 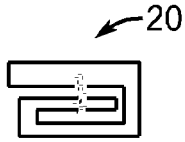  FIG. 1F | 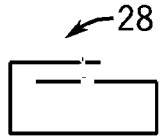  FIG. 1J |
| MULTI–SECTION IMD3 ANTENNA CONCEPT | 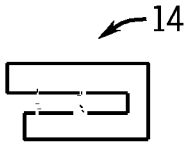  FIG. 1C | 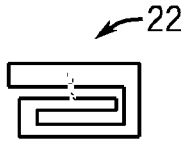  FIG. 1G | 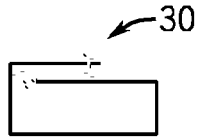  FIG. 1K |
| ADDITIONAL MULTI–SECTION IMD3 ANTENNA CONCEPT | 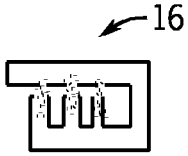  FIG. 1D | 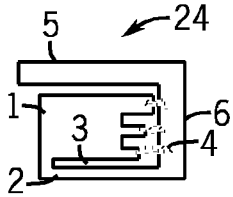  FIG. 1H | 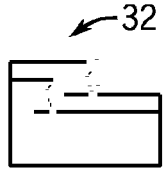  FIG. 1L |
| | | | |

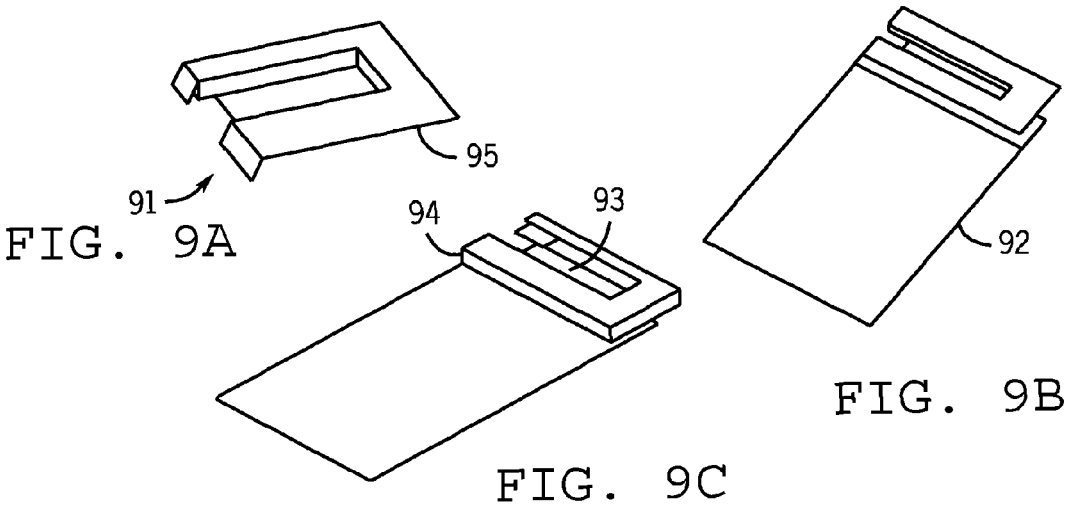
FIG. 9A
FIG. 9B
FIG. 9C
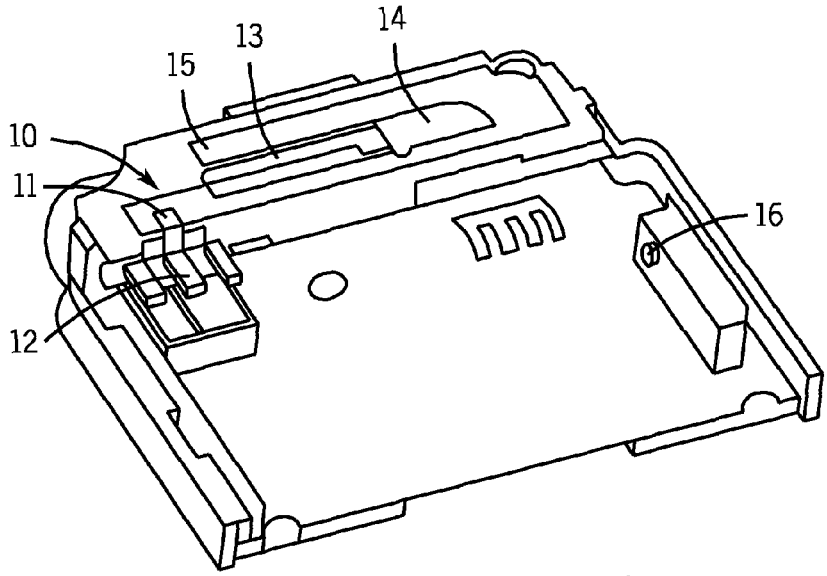
FIG. 10

FIG. 11
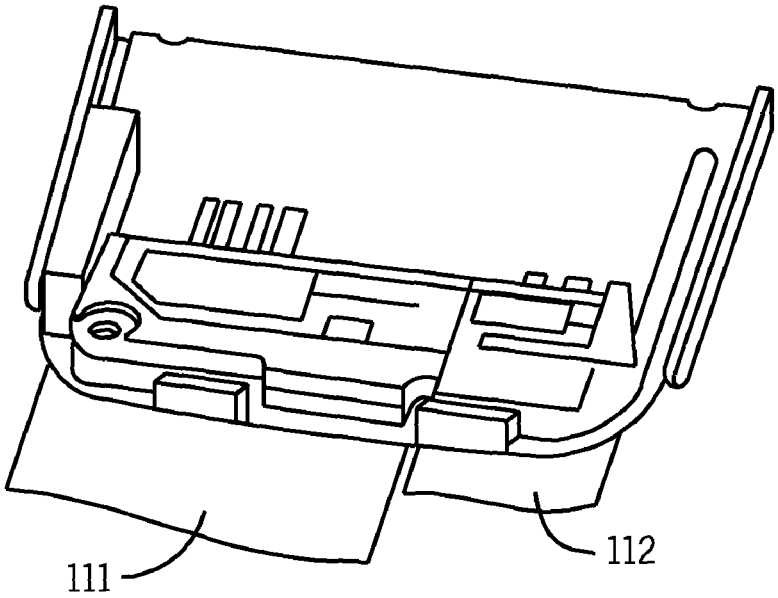
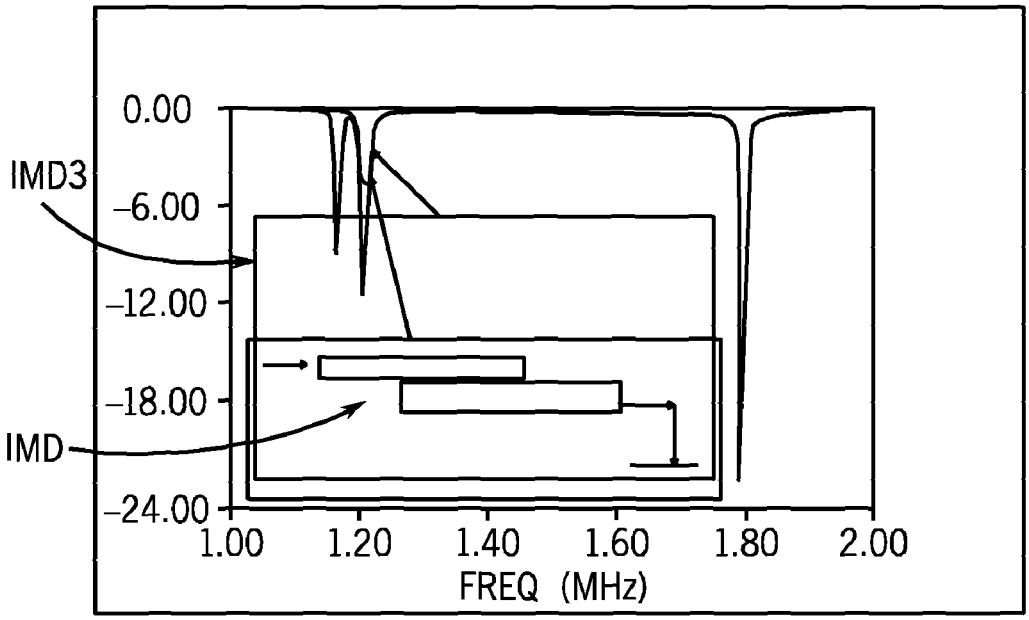
FIG. 12

MULTI-LAYER ISOLATED MAGNETIC DIPOLE ANTENNA

BACKGROUND OF THE INVENTION

The present invention relates generally to the field of wireless communications. In particular, the present invention relates to an antenna for use in wireless communications.

As handsets and other wireless communication devices become smaller and embedded with more applications, new antenna designs are required to address inherent limitations of these devices. With classical antenna structures, a certain physical volume is required to produce a resonant antenna structure at a particular radio frequency and with a particular bandwidth. In multi-band applications, more than one such resonant antenna structure may be required. With the advent of a new generation of wireless devices, such classical antenna structure will need to cover wider bandwidths and maintain or increase efficiency across the entire frequency range.

Wireless devices are also experiencing a convergence with other mobile electronic devices. Due to increases in data transfer rates and processor and memory resources, it has become possible to offer a myriad of products and services on wireless devices that have typically been reserved for more traditional electronic devices. For example, modern day mobile communications devices can be equipped to receive broadcast television signals. These signals tend to be broadcast at very low frequencies (e.g., 200-700 MHz) compared to more traditional cellular communication frequencies of, for example, 800/900 MHz and 1800/1900 MHz.

With present cell phone, PDA, and similar communication device designs having differing form factors, it becomes more difficult to design internal antennas for varying frequency applications to accommodate them. The present invention addresses this issue of current antenna design in order to create more efficient antennas with a higher bandwidth adaptable to fit within present device designs.

SUMMARY OF THE INVENTION

One aspect of the present invention provides for an antenna that comprises a an isolated magnetic dipole (IMD) element positioned above a ground plane, a second conductive element positioned above a ground plane and coupled to the IMD having one or more slot regions being defined between the IMD and the conductive element and one or more capacitive elements positioned across the one or more slot regions.

One embodiment of the present invention provides that a distance between the ground plane and specific portions of the IMD element is varied to accommodate a desired frequency characteristic. Another embodiment is the positioning of a conductive element across portions of the IMD element, with this conductive element typically not residing in the plane of the IMD element. Another embodiment provides that a space between the capacitive element and the IMD element and conductive element is occupied by air. Yet a further embodiment provides that the space is occupied by a dielectric.

A further embodiment provides that the IMD element and the conductive element are offset from one or more additional portions in two or more dimensions. Yet another embodiment provides that the amount of offset in each of the two or more dimensions is varied to achieve a desired frequency band. One embodiment provides that the sections of IMD elements can be oriented such that they are not parallel, and the slot formed by adjacent sections can be tapered, curved, and/or consist of a complex geometry.

Another aspect of the present invention provides a method for forming an antenna that comprises positioning an IMD element above a ground plane, positioning a conductive element above a ground plane, the conductive element being coupled to the IMD element and the IMD element and conductive element defining one or more slot regions and position one or more capacitive element across the slot region.

BRIEF DESCRIPTION OF THE DRAWINGS

FIG. 1A-1L illustrates antennas of various geometries in accordance with embodiments of the present invention.

FIGS. 9A-9C illustrate an antenna assembly in accordance with an embodiment of the present invention.

FIG. 10 illustrates an antenna in accordance with one embodiment of the present invention.

FIG. 11 illustrates an antenna in accordance with another embodiment of the present invention.

FIG. 12 illustrates a graphical representation of the return loss of an IMD and IMD 3 element with and without a capacitive element.

DETAILED DESCRIPTION OF THE PREFERRED EMBODIMENTS

Figure 2A:
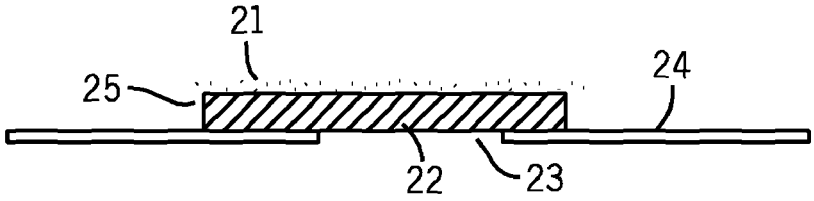
FIGS. 2A-2E illustrate embodiments of the present invention with various placements of the capacitive element.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

The present application provides for a manner in which wireless devices may operate at different frequency bands. Referring to FIG. 1A-1L, a table is provided to illustrate different configurations of embodiments of the present invention. FIG. 1A shows a basic Isolated Magnetic Dipole (IMD) element 10 of the prior art with a singular frequency band which is created by the first and second portions 1, 2 of the antenna paralleling one another. A slot region 3 is defined between the first and second portions. The IMD element provides greater isolation through confinement of the electromagnetic currents on the antenna. The isolation allows for increased efficiency and less frequency de-tuning as a function of change in surroundings.

Referring now to FIG. 1B, a capacitive element 4 is added across the slot region 3 of the antenna 12. The antenna includes a capacitive element that overlaps at least a portion of the resonant "slot", which can been seen in single frequency band IMD. One capacitive element may be utilized, or multiple capacitive elements may be utilized 3, dependent on the bandwidth and frequency bands desired for specific applications. As can be seen in the multi-section IMD3 antenna concept of FIG. 1C, the capacitive elements 4 may vary in width in order to achieve a specific frequency response. The capacitive elements can be positioned above or below the slot. In addition they may be modified in length or distance from the resonant area, or slot regions 3 beneath them. Another embodiment of this concept is provided in FIG. 1D with a multi-section antenna design. This embodiment shows multiple capacitive elements 4 at the resonant area 3 created by parallel sections of the IMD antenna element. The sections can be oriented such that they are not parallel, and the slot formed by adjacent sections can be tapered, curved, and/or consist of a complex geometry.

Another configuration can be seen in the dual frequency band IMD elements of the middle column. The prior art design FIG. 1E, provides an IMD element 18 that has two resonant sections. The addition of the capacitive element in FIG. 1F provides the same functionality as recited before, to increase bandwidth. The capacitive element 4 may be located across either resonant area 3 created on the IMD element 20, or across both slot regions. As well, multiple capacitive elements 4 may be added to one IMD element 22 at multiple locations, as can be seen in FIG. 1G. These capacitive elements 4 may have varied widths. As well, the spacing between the capacitive element and the IMD as well as the amount of overlap may vary in order to obtain more bandwidth FIG. 1H provides another embodiment, which contains dual resonant IMD element with multiple capacitive elements located along the antenna. The length and width of the regions where the capacitive elements couple to the IMD may be varied to obtain the desired frequency response and bandwidth. Each section may contain a capacitive element 4 for tuning variable purposes.

Finally, the third basic IMD configuration in FIG. 1I provides the most simplistic two dimensional wire "G" type configuration, which still contains the resonant area 3 between a first portion 1 and a second portion 2 paralleled to each other as is known in the prior art. This IMD element is a two dimensional structure which provides for more flexibility in placement in wireless devices. However, the wire structure still behaves in a similar manner to the basic IMD element 26 design. Again, the addition of the capacitive element 4 to the IMD element 28 defines the IMD3 concept. The wire design may also include a resonant section 3 that includes a capacitive element 4 that overlaps at least a portion of the resonant "slot" area 3 located between the paralleled portions as seen in FIG. 1J. The capacitive element may vary in width and length in order to provide further variations of the bandwidth and frequency response. As well, there may be multiple locations at which a capacitive element 4 may be utilized in FIG. 1K. The capacitive element 4, dependent on placement, may need to cover more or less of the slot region 3 in order to optimize the bandwidth for a specific frequency response. In yet another embodiment, a multiple section wired IMD3 32 concept is provided. Again, the additional sections created will allow for additional resonant sections to be created. These resonant sections 3 may each contain a capacitive element 4 or jointly share a longer capacitive element to aid in tuning multiple specific variable frequencies at the same time, shown in FIG. 1L.

FIGS. 2A-2E provide multiple configurations for the attachment options of the capacitive element to the IMD element. FIG. 2A provides an embodiment wherein the capacitive element 21 is a conductive element. The capacitive element 21 may have an attachment 25 to one portion of the IMD element 24, and supported underneath by a non-conductive element 22. The capacitive element 21 may cover all or a portion of the slot region 23 created between two parallel portions of the IMD element 24. In addition, the capacitive element may be located at higher distances away from the slot region and contain a larger amount of, or thicker, dielectric in the space created between the capacitor and the resonant area. In another embodiment, space between the capacitive element 21 and the slot region 23 may be occupied partially by air and partially by a dielectric, with the capacitive element not being in contact with the dielectric.

Figure 2B:
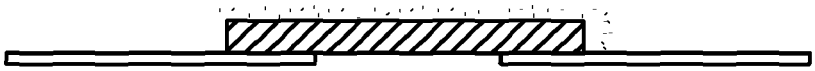

Alternatively, FIG. 2B provides two attachments 25 to both side portions of the IMD element as well as the non-conductive element 22 remaining between the capacitive element 21 and covering the slot region. The insulating non-conductive element 22 may be any dielectric known in the art or air. The dielectric may be chosen dependent on the electromagnetic properties and based on the desired application of the antenna. For instance, dielectrics with higher permittivity may be utilized for to reduce of the frequency of operation. Dielectrics with relatively lower permittivity such as air may be utilized to obtain larger bandwidth. Some example of dielectrics are PVC, polypropylene, ceramic, Plexiglas, silicon, epoxy, Lucite, porcelain, rubber. Those skilled in the art will understand that many other dielectrics may be utilized within the scope of the present invention.

Figure 2C:
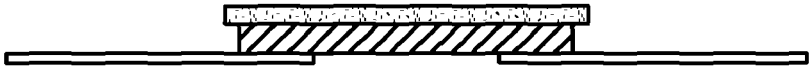

In an alternative configuration, the capacitive element 25 may not even touch the IMD element, being fully supported by the non-conductive element 22 below it, as shown in FIG. 2C. The non-conductive element 22 may vary in thickness in order to modify the capacitance between the capacitive element 25 and the slot region 23. As well, the length of the capacitive element may exceed that of the non-conductive element below it. The thickness of the capacitive element may also vary dependent on the desired capacitance.

Figure 2D:
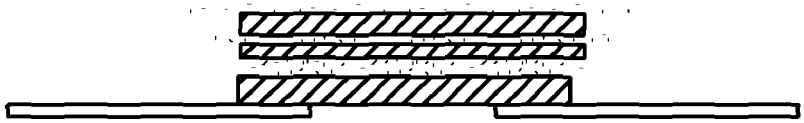

The configuration in FIG. 2C may also be expanded to include embodiments as in FIG. 2D wherein multiple capacitive elements are stacked above the slot region 23 of the IMD element separated by non-conductive elements 22. As previously mentioned, the thickness of the non-conductive elements 22 and the capacitive elements 21 may vary as well as the lengths of each individual element may vary. The capacitive elements may not be in direct connection with the IMD element as is provided within FIG. 2D, or one or more may be in direct connection through an attachment as is shown in one embodiment in FIG. 2E.

Figure 2E:
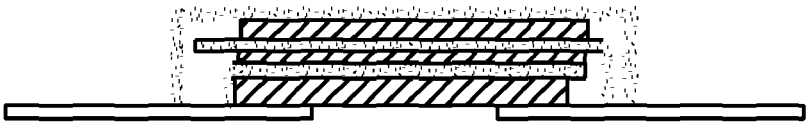

As is provided in FIG. 2E the attachments may be on both sides of the capacitive element or just on one portion. As well, they may alternate attachment, or all be attached on the same portion of the IMD element. Again, the non-conductive element may be any type of dielectric, such as air, plastics or other non-conductive material known in the art. In addition, there may be layers of multiple types of dielectric materials or variable amounts in order to achieve specific results of tunable lower and higher frequencies.

Figure 3:
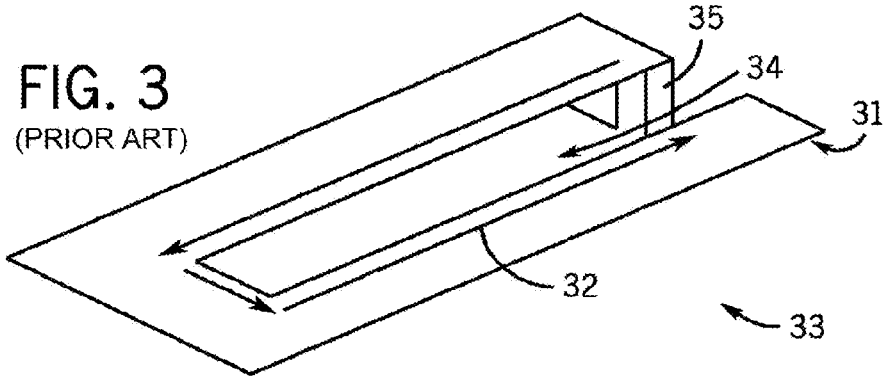
FIG. 3 (PRIOR ART)
FIG. 3 illustrates a conventional IMD antenna.
Figure 4A:
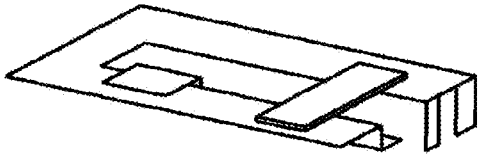
FIGS. 4A-4D illustrate various views of an antenna with a capacitive element in accordance with one embodiment of the present invention.
Figure 4B:
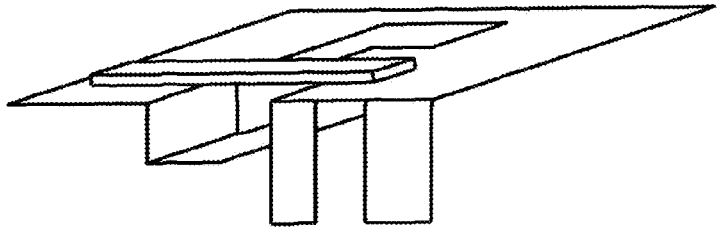
Figure 4C:
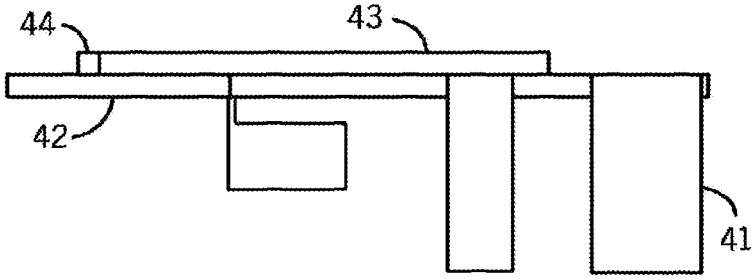
Figure 4D:
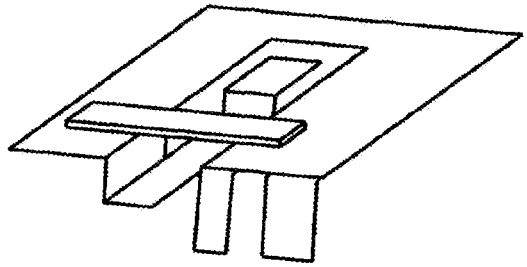

Next, FIG. 3 provides a three dimensional view of a typical IMD element 31 in the prior art situated above a ground plane 33. The ground plane 33 may include a matching circuit incorporated therein. The antenna is utilized to improve efficiency, isolation and selectivity characteristics from embedded antennas in primarily wireless devices. The antenna consists of a slot region 34 and prong type feed and grounded legs 35. A current 32 is induced around the U-shaped antenna structure through a feed port (not shown) and ground of the wireless device. The current 32 is induced in order to generate a strong electric field in the slot region, in the plane of the IMD element 31 instead of a strong fringing field to the ground plane below it. This minimizes the coupled fields to the ground plane 33. With a circuit board of a wireless device acting as the ground plane, an improved efficiency and isolation may be obtained. As was provided in previous FIG. 1, different configurations of these resonant elements may be made in order to address a wide range of frequency bands.

The length of the IMD element 31 may be modified to be longer or shorter dependent on the frequency desired. For instance, longer IMD elements 31 show improved lower frequency ranges. In addition the center slot capacitive region 34 may be wide or narrow. In addition multiple slot regions may be formed, as is provided in FIG. 4. The height of the IMD element 31 also affects the frequency range functionality of the antenna. The portions of an IMD element that contribute to radiation at a low band resonance, which is utilized to radiate at the 850 MHz to 900 MHz bands differs from the portions of the IMD element required for efficient high band propagation at 1800/1900/2100 MHz bands. By displacing the portions of the structure in three dimensions, the IMD element can be optimized at various frequency regions. Lower frequencies will be more efficient when implemented with increased height, such as 6 mm, while higher frequencies will be more efficient with lower heights, such as 4 mm. As well, the height above the ground plane for optimal efficiency varies as antenna operation varies from 1800 MHz to 2200 MHz. Discrete steps in height are applicable, as well as variable and continuous increases or decreases in element height as a function of element length.

FIGS. 4A-4D provides multiple views of an IMD3 element, containing the additional capacitive element 43 overlapping the center slot region created between the two sides of the IMD element. The IMD element provided in this configuration contains multi-level resonant structures. The multi-levels, are manifested by the inner leg of the IMD element being displaced at a height above the ground plane. This can be effective to optimize over multiple frequency bands, as well as to accommodate different geometries in wireless devices. As well, this allows for improved optimization of the antenna bandwidth and efficiency characteristics as a function of frequency.

In this embodiment, multiple resonant sections may be created at different heights on the antenna. In addition each resonant region may be individually covered by a capacitive element. A dielectric 42 is shown below the capacitive element 43, however the area may also be occupied by air if the capacitive element has an attachment leg to the IMD element. In this embodiment, the capacitive element has an attachment 44 on one portion of the IMD element, similar to configurations provided within FIGS. 1 and 2.

Figure 5:
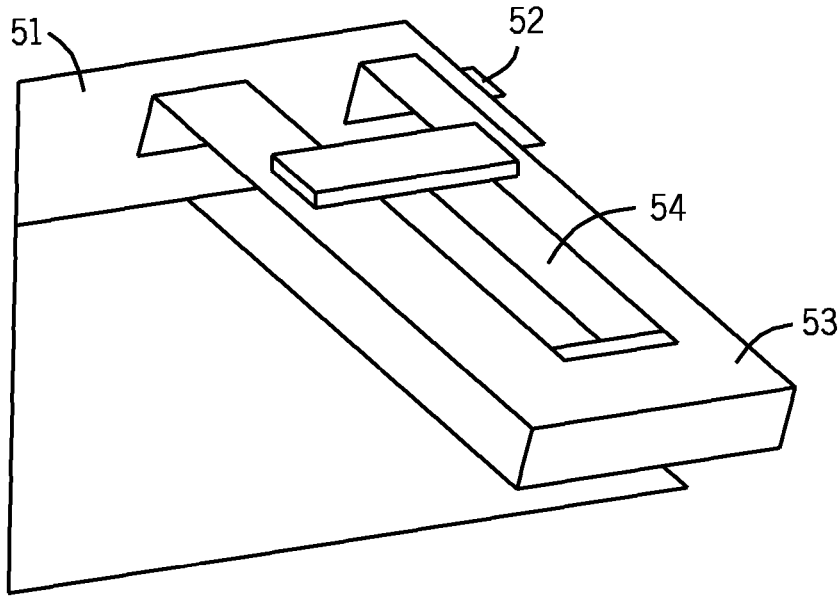
FIG. 5 illustrates another antenna in accordance with an embodiment of the present invention.

Further, FIG. 5 provides an exemplary embodiment of the connection of the IMD3 element to a wireless cellular device. In this embodiment, the capacitive element 52 is connected to the plastic enclosure 51 of the wireless device, still remaining above the resonance area, or slot region 54 of the IMD element 53. The connection to the back housing may be made by heat stakes, adhesives, or a similar type of attachment method. As well, to accommodate previously placed IMD elements, the capacitive element may be later heat staked to the back housing of the wireless device. This embodiment utilizes the plastic, or other material of the back of the phone as the non-conductive, or dielectric, element between the capacitive element and the antenna, or IMD element.

Figure 6:
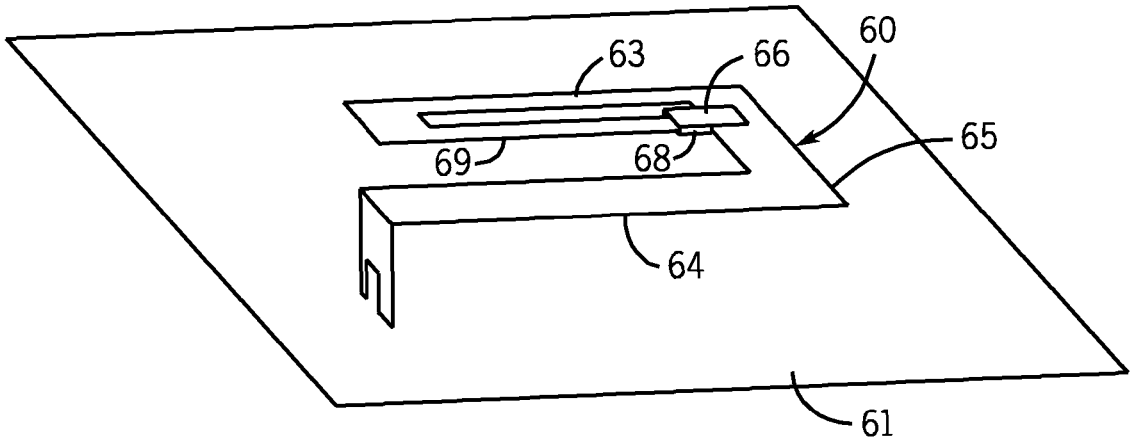
FIG. 6 illustrates an antenna in accordance with another embodiment of the present invention.

Another exemplary embodiment of the IMD3 configuration may be seen in FIG. 6. The IMD element 60 provided contains a dual resonance with a "G" type design, with the first resonance area created by back portions 63 and center portion 69 and the second resonance area between the front portion 64 and the center portion 69. The IMD element 60 is above the ground plane 61 having the connection of the feed through one of the legs, with the other leg connected to the ground plane 61. The capacitive element may be located at the end of the center portion 69 of the IMD element 60, containing a dielectric 68 below it. The capacitive element 66 may be directly attached to the IMD element 60 or indirectly in connection with the element through the dielectric. In the present configuration, the capacitive element 66 is formed as an extension of the main metal section utilized to form the center portion 69 of the IMD element 60. The capacitive element 66 is wider and longer to cover more area of the IMD element 60. However, the capacitive element may vary in length as well as width dependent on the frequency characteristic desired for the antenna.

Figure 7:
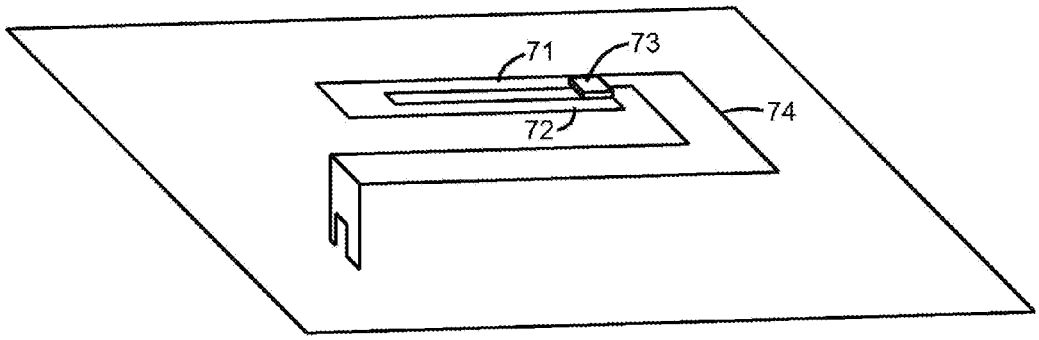
FIG. 7 illustrates an antenna in accordance with another embodiment of the present invention.
Figure 8:
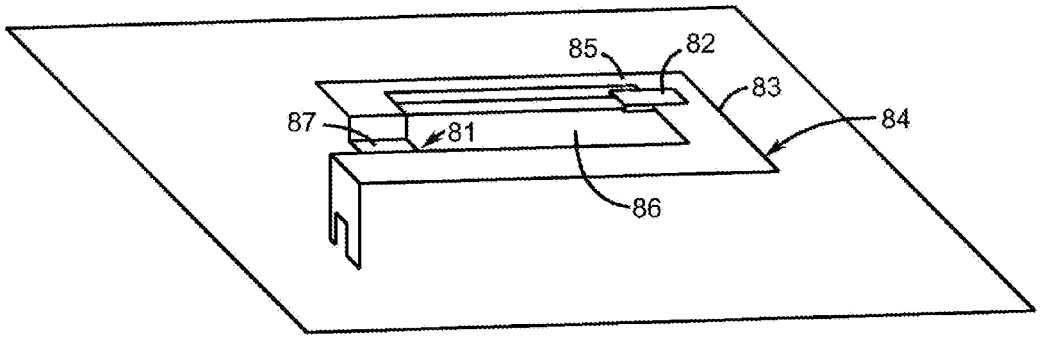
FIG. 8 illustrates an antenna in accordance with another embodiment of the present invention.

FIGS. 7 and 8 each provide different exemplary configurations of capacitive elements coupling to various portions of the antenna to create the IMD3 elements. The IMD element 74 in FIG. 7 is similar to FIG. 6, but has the capacitive element 73 attached to a different rear portion 71 of the antenna. Similar to FIG. 6, the capacitive element may be an extension of the end portion 72 of the IMD element 74 or alternatively configured to have no direct connection to the IMD element 74 being suspended above it on a dielectric. In addition, the capacitive element 73 may have attachments to both the rear portion 71 and the end portion 72 or only to the rear portion 71. The capacitive element 73 may have multiple levels similar to FIGS. 2D-2E as well as multiple lengths, if desirable.

FIG. 8 contains the capacitive element 82 located at the side portion 83 of the IMD element 84 in order to vary the bandwidth at a first resonant section 85. However, FIG. 8 also provides that the IMD element 84 contains a displaced section 87 similar to FIG. 4, in order to optimize a different frequency within the same antenna element. The displaced section 87 contains a second capacitance 81 region overlapping a secondary resonant area 86, but at a lowered height. Again, the variable height along with capacitive element allows for optimization of bandwidth and efficiency at several different frequency bands. This height may be increased (i.e. further from the ground plane) in order to increase efficiency at lower frequencies and lower (i.e. closer to the ground plane) in order to increase efficiency at higher frequencies.

FIGS. 9A-9C illustrate the IMD element assembly 91 on a multilevel carrier. FIG. 9A illustrates the IMD element assembly, and FIGS. 9B and 9C illustrate various perspectives of the IMD element assembly mounted on an enclosure 92. The antenna 91 may be heat staked 93 to the enclosure 92 of the wireless device, having a leg component 94 for connection to the feed point of the antenna element 91. In addition, the antenna element 91 may be separated from the circuit board of the phone through use of a dielectric 95 or be modified to accommodate the design of the wireless device. In addition to utilizing heat stakes the assembly may be done through an adhesive or other attachment means well known in the art. The antenna element may remain on one consistent height above the ground plane (created by the circuit board and back of the wireless device) or lie in multiple dimensions.

FIG. 10 provides an exemplary three dimensional attachment of a multi-level IMD component modified to conform for a wireless device. There may be multiple resonant slot regions created by a first and second portion of the antenna element. One or more of these slots regions may lie on a singular plane 11, 14 while others are normal to those regions 13, or lie in a completely different plane from them 12. The variability in dimension allows for increased bandwidth and efficiency at multiple different frequency bands. The two legs of the antenna, one ground and one feed, still remain in direct contact with the circuit board in order to feed antenna element 10. A ground leg may or may not be required to impedance match the antenna for this or the other designs. The element, as shown in one embodiment of FIG. 10, provides a design that is modified according to a pre-existing design of a wireless device. The end portion 15 may extend to greater distances as well as any other portion may be modified according to the desired frequency characteristic of each wireless device. The present embodiment provides heat staking for attachment of the antenna element 10, however adhesives or other attachment methods may be utilized.

Similarly, FIG. 11 provides an alternative embodiment of the element located on the same device from another view point. The IMD element has multiple multi-level and multi-section resonant portions. The superior isolation characteristics of the IMD technology allow for closely spaced, yet de-coupled, resonant structures. As can be seen, with a single antenna structure broken up into two separate resonant sections 111, 112, each section may be optimized for a specific frequency range and contain multiple slot regions. This allows for improved efficiency and bandwidth characteristics at each band, since the resonant sections can be optimized for a single frequency range.

FIG. 12 provides a simulation of the graphical representation of return loss for a typical IMD element. The IMD3 element, with the capacitive element, shows improved bandwidth at the original lower resonance and also creates a lower frequency resonance, providing a greater and more flexible frequency response. IMD3 is terminology used to describe antenna features covered in this patent description, and refers to a more efficient utilization of three dimensional space.

Figure 13:
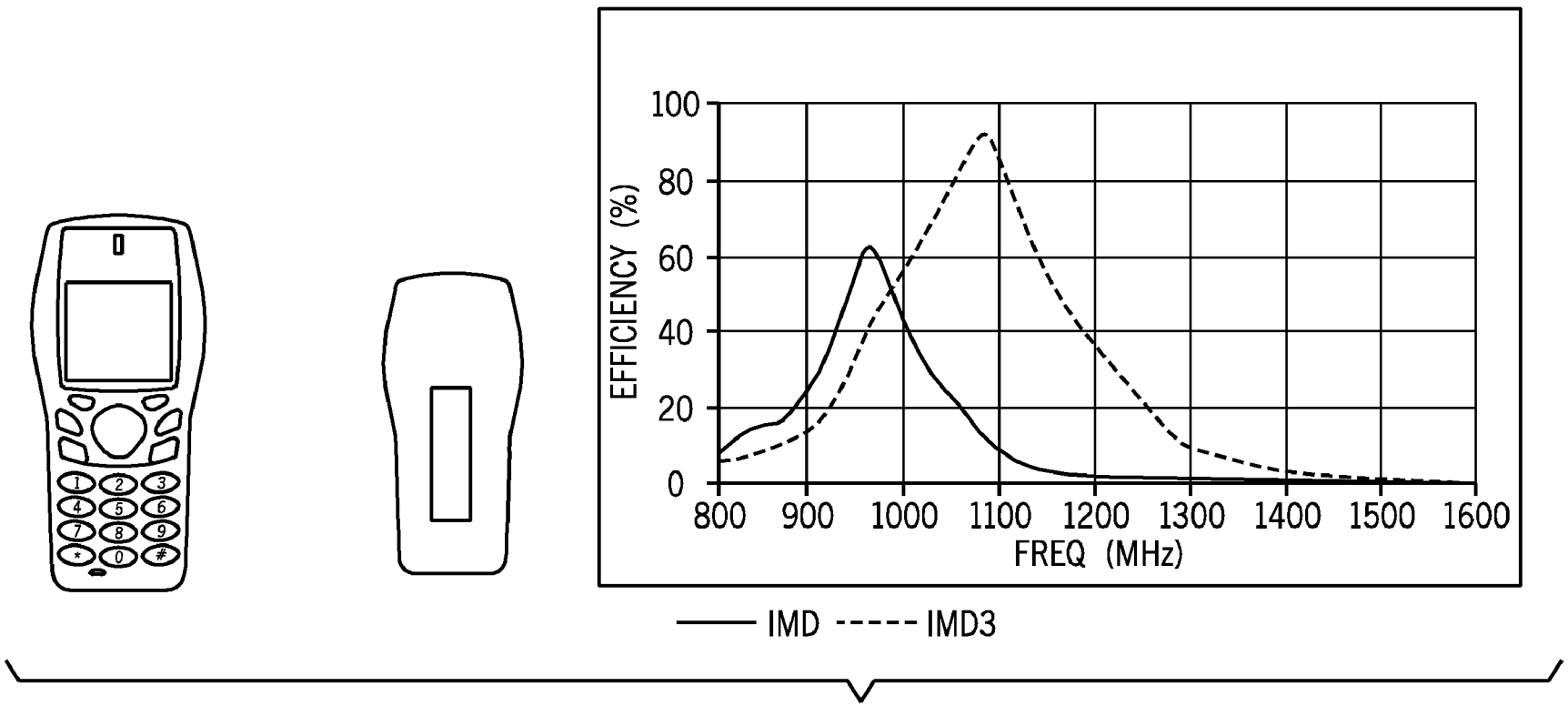
FIG. 13 illustrates a graphical representation of the efficiency of an IMD and IMD3 element within a wireless device.
Figure 14:
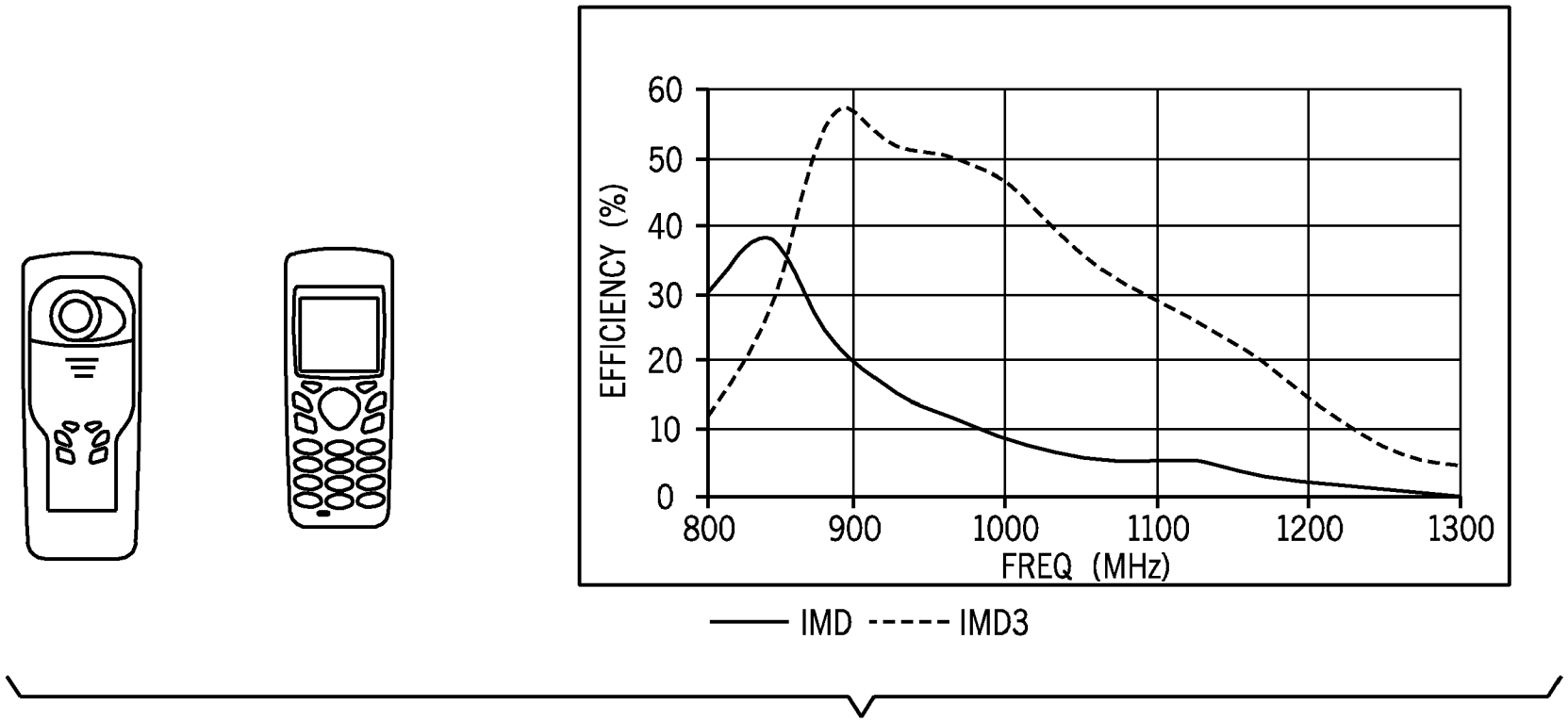
FIG. 14 illustrates a graphical representation of the efficiency of an IMD and IMD3 element within another wireless device.
Figure 15:
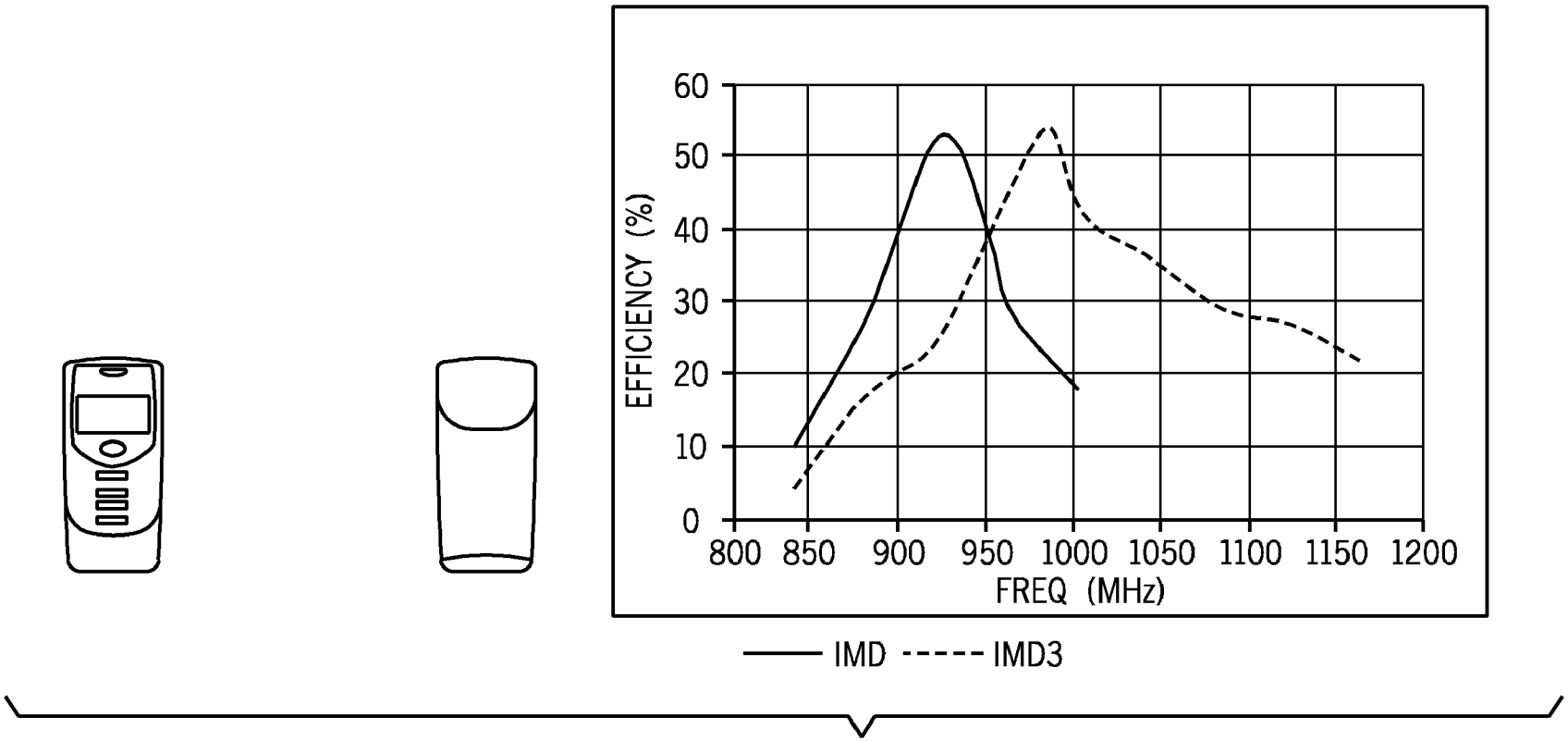
FIG. 15 illustrates a graphical representation of the efficiency of an IMD and IMD3 element within yet another wireless device.

Next, FIGS. 13, 14 and 15 provide exemplary graphical results of the efficiency of different cellular wireless devices at frequency ranges of 800 MHz up to 1600 MHz. FIGS. 13, 14, and 15 show a large increase in both efficiency and bandwidth for an IMD3 antenna compared to a standard IMD antenna.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

What is claimed is:

1. An antenna, comprising:

an isolated magnetic dipole (IMD) element positioned above a ground plane;

a conductive element positioned above a ground plane and coupled to the IMD element, one or more slot regions being defined between the IMD element and the conductive element; and one or more capacitive elements positioned across the one or more slot regions.

2. The antenna of claim 1 wherein a distance between the ground plane and the IMD element or the conductive element is varied to accommodate desired frequency characteristic.

3. The antenna of claim 1, wherein a space between the capacitive element and the first or conductive element is occupied by air.

4. The antenna of claim 1, wherein a space between the capacitive element and the IMD element and conductive element is occupied by a dielectric.

5. The antenna of claim 1, wherein the distance between the capacitive element and the IMD element and conductive element is varied according to a desired frequency characteristic.

6. The antenna of claim 1, wherein the ground plane is partially or completely removed beneath the antenna.

7. The antenna of claim 1, wherein the conductive element is positioned across a portion of the IMD element.

8. The antenna of claim 1, wherein sections of IMD element can be oriented such that they are not parallel, and the slot formed by adjacent sections can be tapered, curved, and/or consist of a complex geometry.

9. The antenna of claim 1, wherein the IMD element and conductive element are offset from one or more additional IMD elements and conductive elements in two or more dimensions.

10. The antenna of claim 9, wherein an amount of offset in each of the two or more dimensions is varied to achieve a desired bandwidth.

11. A method for forming an antenna, comprising:

positioning an isolated magnetic dipole (IMD) element above a ground plane;

positioning a conductive element above a ground plane, the conductive element being coupled to the IMD element, the IMD element and conductive element defining one or more slot regions; and positioning one or more capacitive elements across the slot region.

12. The method of claim 11 further comprising the step of selecting a distance between the capacitive element and the ground plane.

13. The method of claim 11 wherein a distance between the ground plane and the IMD element or the conductive element is varied according to a desired frequency characteristic.

14. The method of claim 11, wherein a space between the capacitive element and the first or conductive element is occupied by air.

15. The method of claim 11, wherein a space between the capacitive element and the first or conductive element is occupied by a dielectric.

16. The method of claim 11, wherein the distance between the capacitive element and the first or conductive element is varied according to a desired frequency characteristic.

17. The antenna of claim 11, wherein the ground plane is partially or completely removed beneath the antenna.

18. The antenna of claim 11, wherein the conductive element is positioned across a portion of the IMD element.

19. The method of claim 11, wherein the IMD element and conductive element are offset from one or more additional IMD elements and conductive elements in two or more dimensions.

20. The method of claim 19, wherein an amount of offset in each of the two or more dimensions is varied to achieve a desired bandwidth.

* * * * *